United States Patent [19]

Gonner et al.

[11] 4,309,156

[45] Jan. 5, 1982

[54] FLUID ACTIVATED PUMP HAVING VARIABLE DISCHARGE

[75] Inventors: Winfried Gonner; Bernhard Huber, both of Uberlingen, Fed. Rep. of Germany

[73] Assignee: The Perkin-Elmer Corporation, Norwalk, Conn.

[21] Appl. No.: 96,869

[22] Filed: Nov. 23, 1979

[30] Foreign Application Priority Data

Mar. 23, 1979 [DE] Fed. Rep. of Germany ..... 2911443

[51] Int. Cl.[3] ..... F04B 35/02; F15B 15/24

[52] U.S. Cl. ..... 417/403; 92/13.1; 92/13.6

[58] Field of Search ..... 417/401, 403; 92/13.1, 92/13.6

[56] References Cited

U.S. PATENT DOCUMENTS

| | | | |
|---|---|---|---|
| 2,430,597 | 11/1947 | Acton | 92/13.1 X |
| 2,478,790 | 8/1949 | Stephens | 92/13.1 X |
| 2,538,812 | 1/1951 | Umberger | 417/403 X |
| 3,168,853 | 2/1965 | Prince | 92/13.1 X |
| 3,492,946 | 2/1970 | Martin | 417/401 |
| 3,621,865 | 11/1971 | Baggaley | 417/401 X |
| 3,793,925 | 2/1974 | Collin | 92/13.1 |
| 4,047,850 | 9/1977 | Berthelot | 417/403 X |

*Primary Examiner*—Leonard E. Smith

*Attorney, Agent, or Firm*—S. A. Giarratana; F. L. Masselle; R. A. Hays

[57] ABSTRACT

A fluid activated pump that is particularly well suited for use in analytic machines of the type that need to accurately meter quantities of sample solutions. The pump, which includes a pump piston driven by a power piston, is powered either hydraulically or pneumatically. Also included in the pump is a displacement adjustment piston, which is either hydraulically or pneumatically controlled, and which, through a suitable shaft-type linkage, can adjust the length of the power piston's stroke, and thus permit either a large or small displacement of the pump piston. The fact that the pump piston's displacement can be changed means that the pump of the present invention can more efficiently meter solutions into various desired ratios, and can reduce the chance of cross-contamination of sample solutions by dispensing a large amount of rinsing solution after dispensing a relatively small amount of sample solution.

5 Claims, 2 Drawing Figures

FLUID ACTIVATED PUMP HAVING VARIABLE DISCHARGE

BACKGROUND OF THE INVENTION

1. Field of the Invention

This invention relates generally to pumps and more particular to the metering-type pumps commonly used in analytical instruments.

2. Description of the Prior Art

Some analytical instruments have need for a metering-type pump to accurately measure quantities of solutions. For example, if an analytical instrument is to be used to perform a 1:100 dilution, a fixed displacement metering-type pump could be used to pump one part of a first solution into a vessel and then to pump one hundred parts of a second solution into the vessel. It may be appreciated, then, that a single 1:100 dilution would require 101 cycles of a fixed displacement metering-type pump, which not only is a very time-inefficient method of achieving such a dilution but which also subjects the pump to considerable wear.

A metering-type pump which has advantages over the above mentioned pump is one that is driven by a stepping motor. The discharge volume of the pump can be varied in a well-defined manner by selectively controlling the number of times the stepping motor is actuated. Such pumps are, however, very expensive.

Another way to overcome the disadvantages of the first mentioned dilution system is to construct an array of pumps of differing displacements and to couple them together in parallel. This again is an expensive solution to the problem and further suffers the disadvantage that a rinsing effect of the plurality of pumps is difficult, leading to a possible cross-contamination of the two solutions to be mixed.

In short, what the prior art fails to provide is a simple, inexpensive metering-type pump capable of quickly and efficiently performing such dilution operations and one which is designed to minimize the chance of cross-contaminating the solutions being handled.

SUMMARY OF THE INVENTION

It is therefore the primary object of this invention to construct a metering-type pump that overcomes the disadvantages of prior art, i.e., one that can quickly and efficiently perform operations such as dilutions, without resorting to expensive stepping motors or a parallel array of pumps, and one which minimizes the chance of cross-contamination of metered solutions.

Briefly, the invention comprises a pump cylinder, a displacement adjustment cylinder and a power cylinder coaxially disposed between the pump cylinder and the adjustment cylinder. Each of the three cylinders are provided with a corresponding piston. The pump cylinder piston and the power cylinder piston are coupled together by a connection shaft so that, as the power piston is driven back and forth under the influence of a fluid, under external pressure, the pump piston likewise is driven back and forth, allowing accurately metered quantities of solution to be pumped into and out of the pump cylinder. An adjustable stop shaft is coupled to the adjustment piston and has an end that is adapted to engage the lower face of the power piston. When a fluid pressure is applied to the adjustment cylinder the stop shaft forces the power piston upwardly and thus shortens its power stroke which, in turn, causes the pump piston to displace less solution with each cycle.

An advantage of this invention is that a single, fluid activated pump can accurately measure two different discharge volumes. For example, in the dilution problem previously mentioned, only two cycles of the pump would be needed to complete the dilution operation even if the ratio between the two attainable discharge volumes of the pump was as high as 1:100.

A further advantage of this invention is that it is possible to minimize the possibilities of cross-contamination of solutions by always having the pump intake and discharge a large quantity of rinse solution after every small intake and discharge of the active solution.

Yet a further advantage of this invention is that it is relatively simple in comparison with the complex prior art pump systems previously mentioned and is thus an economical alternative to those systems.

These and other objects and advantages of the present invention will become apparent by following descriptions and the accompanying drawings which illustrate the preferred embodiments of the invention.

DETAILED DESCRIPTION OF THE PREFERRED EMBODIMENTS

Figure 1:
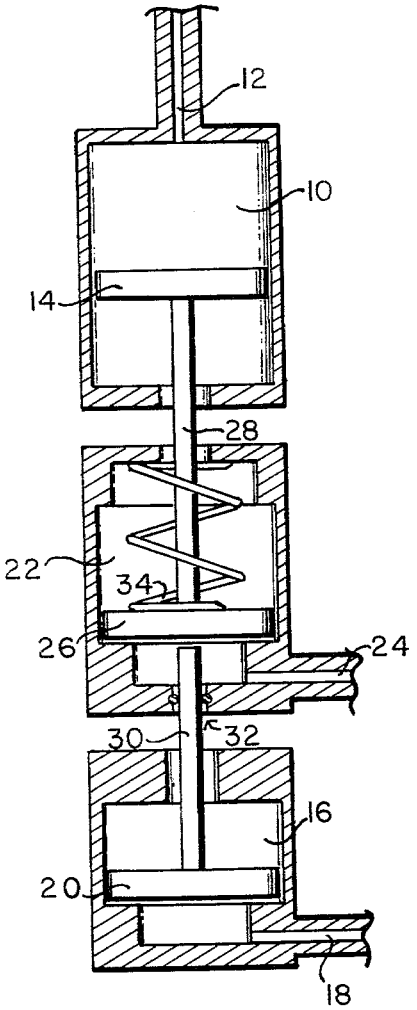
FIG. 1 is a cross-sectional view of a fluid-activated pump having variable discharge in accordance with the present invention.

Referring to the embodiment of FIG. 1, the fluid-activated pump of the present invention includes a pump cylinder 10 having a cylinder port 12, and a pump piston 14. Also included is a displacement adjustment cylinder 16 provided with a port 18, and a displacement adjustment piston 20. Positioned coaxially between cylinders 10 and 16 is a power cylinder 22 provided with a port 24, and a power piston 26.

Pistons 14 and 26 are coupled together by a connection shaft 28 so that the displacement of one will cause a corresponding displacement of the other. An adjustment or stop shaft 30 is attached at a first end to piston 20 and the second end is adapted to contact the face of piston 26 opposite the shaft 28. The second end of the stop shaft 30 enters cylinder 22 through a sealed aperture 32.

A spring 34 is provided within the power cylinder to bias the power piston 26 toward shaft 30. As can be seen in this figure, piston 26 can rest upon a shoulder formed within cylinder 22 just out of contact with the second end of shaft 30 when adjustment piston 20 rests at the bottom of cylinder 16.

In use, when a fluid under pressure is applied to port 24, the power piston 26 will move upwardly to contact the upper shoulder shown formed within the power cylinder 22. This displacement is transmitted to the pump piston 14 by shaft 28 and thus causes the pump piston to expel or discharge any fluid that might be within cylinder 10 through the port 12. When fluid pressure is removed from port 24, the power piston is urged back to its initial position by spring 34, thus causing pump piston 14 to make an intake stroke.

When a fluid under pressure is applied to port 18, adjustment piston 20 is displaced from its first position where it rests on a lower shoulder of cylinder 16 to a second position where it is stopped by the upper shoulder of cylinder 16. This displacement causes stop shaft 30 to press upon and raise the power piston 26 to shorten the length of the intake and discharge stroke of the pump piston 14, thereby reducing the effective volume of the cylinder 10 and therefore its pumping capacity. The lessened volume corresponds to the difference in volumes between cylinders 16 and 22, as measured between the shoulders.

Figure 2:
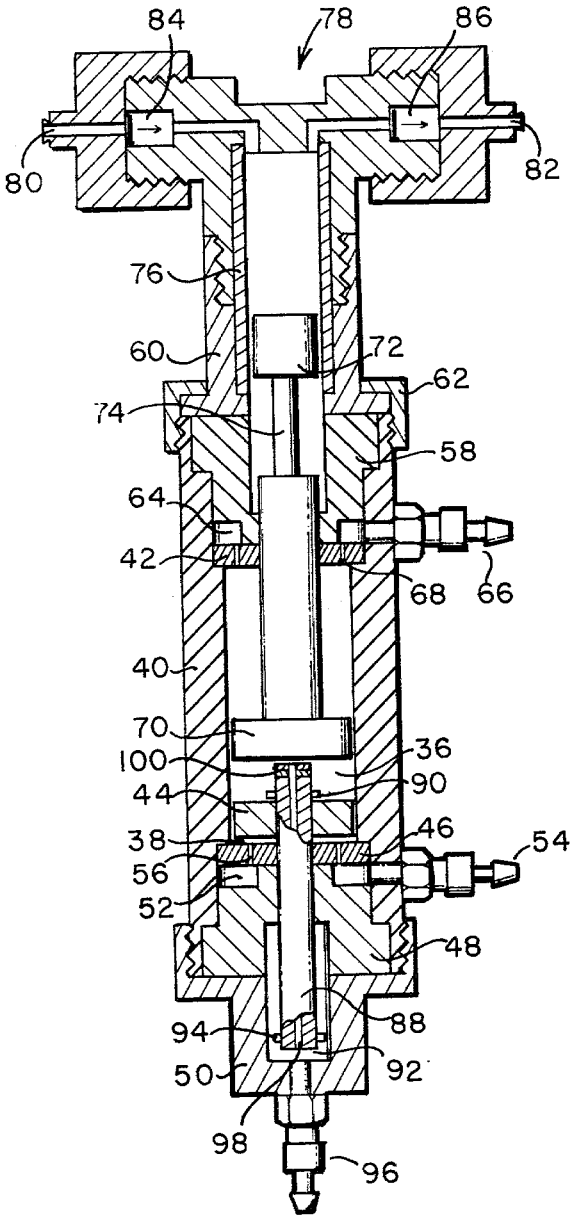
FIG. 2 is a cross-sectional view of another embodiment of the invention.

Referring now to the embodiment of FIG. 2, a power cylinder 36 and a displacement adjustment cylinder 38 are shown to be partially defined by a single continuous cylinder sleeve 40. The power cylinder 36 is further defined as extending from a first end plate 42 to the upper face of a displacement adjustment piston 44, and adjustment cylinder 38 is further defined as extending from a second end plate 46 to the lower face of adjustment piston 44. Thus, the volumes of both the power cylinder 36 and the adjustment cylinder 38 of this embodiment are variable depending upon the location of adjustment piston 44 within sleeve 40.

Plate 46 is held in position by a coaxial member 48 and a first end cap 50. An annular chamber 52 is defined between member 48 and end plate 46. A fluid port 54 opens into chamber 52. Bores 56 are provided through plate 46 to allow communication between chamber 52 and cylinder 38.

Plate 42 is held in place by a coaxial member 58, a flanged sleeve 60 and an end cap 62. An annular chamber 64 is defined between member 58 and plate 42. A fluid port 66 opens into the chamber 64. Bores 68 are provided through plate 42 to allow communication between chamber 64 and cylinder 36.

A power piston 70 is slidably disposed within the power cylinder 36 and divides that cylinder into upper and lower portions. The power piston is coupled to a coaxial pump piston 72 by a connection shaft 74, which passes through suitable seals in plate 42 and member 58. The pump piston 72 is movable within a pump cylinder 76 which is partially telescoped within the flanged sleeve 60. A "T" shaped fitting 78 is placed over cylinder 76 and is engaged with sleeve 60.

Fitting 78 defines a fluid intake port 80 and a discharge port 82. The intake port 80 is provided with a check valve 84 and, likewise, the discharge port is provided with a check valve 86.

An adjustable stop shaft 88 is guided through piston 44 to contact the lower face of power piston 70. Shaft 88 is provided with a first lateral stop pin 90 which has a function to be discussed subsequently. The shaft 88 passes through suitable seals in plate 46 and member 48 and into an elongated coaxial pressure chamber 92 counterbored between member 48 and end cap 50. The end of shaft 88 that is within chamber 92 is provided with a second lateral stop pin 94 which limits the upward displacement of the shaft. A fluid port 96 opens into chamber 92.

Shaft 88 is tubular and is provided with an axial bore 98 through which fluids in chamber 92 and cylinder 36 may communicate. Limited adjustment of the length of the shaft 88 may be made by the addition of spacers 100 to the end of the shaft within the power cylinder 36.

In a first mode of operation, port 54 is not pressurized so that piston 44 attains the position shown. When external pressure is applied to port 66 and removed from port 96 the power piston 70 is forced downwardly until its lower face contacts spacers 100 on the stop shaft 88. The pump piston 72 thus makes a full intake stroke. When, subsequently, port 96 is pressurized and the pressure at port 66 is released, power piston 70 will move upwardly until limited by plate 42, causing the pump piston to make a full discharge stroke. In this mode of operation the pump has a large discharge volume.

When a fluid pressure is applied to port 54 that is sufficiently greater than the fluid pressure applied to ports 66 or 96, the adjustment piston 44 will move upwardly. Shaft 88 will also move upwardly due to the engagement of stop pin 90 with piston 44, and will continue to move upwardly until stop pin 94 engages member 48. Now when fluid ports 66 and 96 are alternately pressurized, pump piston will make a shortened stroke defined as the distance between the end of shaft 88 and the lower face of plate 42, minus the thickness of piston 70. Thus, in this mode of operation, i.e., when port 54 is pressurized, the pump has a relatively small discharge volume.

While this invention has been described with reference to a couple of preferred embodiments, it is contemplated that various alterations and permutations thereof will become apparent upon a reading of the preceding descriptions. For example, a number of adjustment cylinders and pistons could be used to produce a number of different discharge volumes for the pump.

It is therefore intended that the following appended claims be interpreted as including all such alterations and permutations as fall within the true spirit and scope of this invention.

What is claimed is:

1. A fluid activated pump having variable discharge volume comprising:

a pump cylinder means, a pump piston slidably disposed within said pump cylinder, and a pump cylinder porting means allowing external communication with a portion of the interior of said pump cylinder means;

a displacement adjustment cylinder means, a displacement adjustment piston disposed within said adjustment cylinder means and slidable therein between a first position and a second position, and an adjustment cylinder porting means allowing external communication with a portion of the interior of said adjustment cylinder means, said adjustment porting means being a single port through which fluid both inflows and outflows;

a power cylinder means coaxially positioned between said pump cylinder means and said adjustment cylinder means, a power piston slidably disposed within said power cylinder means, and a power cylinder porting means allowing external communication with a portion of the interior of said power cylinder means, said power cylinder means being provided with a first fixed stop means for limiting the motion of said power piston toward said pump cylinder means, said power cylinder means and said adjustment cylinder means are different sections of a single, continuous cylinder sleeve;

a connection shaft coupling said pump piston and said power piston;

stop shaft means coupled to said adjustment piston so that an end thereof is adapted to contact a face of said power piston, said stop shaft means being provided with an axial bore sealingly guided through said adjustment piston, a first end thereof being provided with a first stop for engaging a face of said adjustment piston, a second end thereof being provided with a second stop for engaging an extension of said adjustment cylinder to limit the movement of said stop shaft toward said power piston, said second end being disposed within a pressure chamber upon which said power cylinder port opens; and power piston return means adapted to displace said power piston toward said stop shaft, said power piston return means includes a power piston return port through which a pressurized fluid may enter said power cylinder means on a side of said power piston opposing that of said power cylinder port, whereby providing a fluid pressure at said return port causes said power piston to be urged toward said adjustment cylinder;

whereby a transient fluid pressure applied to said power cylinder port means causes said power piston to be first displaced toward and then away from said pump cylinder, thus causing said pump piston to have a discharge and then an intake stroke, and whereby a fluid pressure applied to said adjustment cylinder porting means causes said adjustment piston to move to said second position and thus, through the agency of said stop shaft, shorten the stroke of said power piston and reduce the volume of fluid drawn into and discharged by said pump piston.

2. A pump as claimed in claim 1 wherein said power cylinder porting means is a single port through which fluid both inflows and outflows.

3. A pump as claimed in claim 1 wherein said pump cylinder porting means is a single port through which fluid both inflows and outflows.

4. A pump as claimed in claim 1 wherein said pump cylinder porting means includes:

an inflow port provided with a first check valve, and an outflow port provided with a second check valve.

5. A pump as claimed in claim 1 wherein said first end of said stop shaft is provided with at least one adjustment spacer.

* * * * *